US007021619B2

(12) United States Patent
Watanabe et al.

(10) Patent No.: US 7,021,619 B2
(45) Date of Patent: Apr. 4, 2006

(54) AUTOMATIC DOCUMENT FEEDING APPARATUS

(75) Inventors: Yasuhito Watanabe, Yamanashi-ken (JP); Tatsuzo Aoyagi, Minami Alps (JP); Fumihito Endo, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 0 days.

(21) Appl. No.: 10/600,527

(22) Filed: Jun. 23, 2003

(65) Prior Publication Data

US 2004/0065991 A1 Apr. 8, 2004

(30) Foreign Application Priority Data

Jun. 24, 2002 (JP) ..... 2002-182640

(51) Int. Cl.
*B65H 5/00* (2006.01)

(52) U.S. Cl. ..... 271/3.14; 271/10.01; 271/264; 271/4.01; 399/367; 358/1.12

(58) Field of Classification Search ..... 271/3.14, 271/3.18, 4.01, 4.05, 4.07, 4.08, 4.1, 10.01, 271/10.06, 10.08, 10.09, 10.11, 264; 399/367; 358/1.12

See application file for complete search history.

(56) References Cited

U.S. PATENT DOCUMENTS

| | | | | | |
|---|---|---|---|---|---|
| 3,762,813 | A * | 10/1973 | Fowlie et al. | 399/364 |
| 5,816,569 | A * | 10/1998 | Hoshi et al. | 271/117 |
| 5,887,866 | A * | 3/1999 | Yamauchi et al. | 271/116 |
| 6,076,822 | A * | 6/2000 | Baba et al. | 271/10.09 |
| 6,219,511 | B1 * | 4/2001 | Okada | 399/203 |
| 6,644,658 | B1 * | 11/2003 | Sheng et al. | 271/264 |
| 6,747,763 | B1 * | 6/2004 | Lin | 399/367 |
| 2003/0141654 | A1 * | 7/2003 | Nishikata et al. | 271/264 |

FOREIGN PATENT DOCUMENTS

| | | |
|---|---|---|
| JP | S53-71325 | 6/1978 |
| JP | H05-92840 | 4/1993 |
| JP | H09-37020 | 2/1997 |
| JP | 10236690 | * 9/1998 |
| JP | 2000327168 | * 11/2000 |

* cited by examiner

*Primary Examiner*—Donald P. Walsh
*Assistant Examiner*—Thomas Morrison
(74) *Attorney, Agent, or Firm*—Manabu Kanesaka

(57) ABSTRACT

An automatic document feeder is provided with a reading unit disposed above a platen for reading an original. The reading unit includes a platen roller for transporting the original to the reading unit; a guide device arranged between the platen and the platen roller and formed in a curved original reading path; a pressing device for pressing the guide device against the platen roller; and a regulating device for creating a space between a surface of the platen roller and an upper surface of the platen. When the original is transported between the platen roller and the guide device, the original moves the guide device toward the platen.

16 Claims, 6 Drawing Sheets

AUTOMATIC DOCUMENT FEEDING APPARATUS

BACKGROUND OF THE INVENTION AND RELATED ART STATEMENT

The present invention relates to an original reading apparatus provided in an image forming apparatus such as a copier or facsimile, and particularly to an automatic document feeding apparatus or feeder in an original reading apparatus.

In an optical reading apparatus provided in an image forming apparatus, methods of reading an original include a stationary original reading method in which transport means such as a belt or roller feeds an original on a platen, and an optical reading system scans the original placed stationary on the platen to read an image on the original, and a sheet through reading method in which an optical reading system situated at a fixed reading position reads an original while a feeding apparatus is transporting the original.

In the sheet through reading method, a conventional original reading apparatus includes the first platen for placing the original and the second platen arranged adjacent to the first platen. In the original reading apparatus, reading means moves in a sub-scanning direction (original transport direction) to read the original such as a book placed stationary on the first platen. Also, the original supplied from a sheet supply tray in an original feeding apparatus passes over the second platen, and the stationary reading means established below the second platen reads an image on the original.

In the conventional original reading apparatus with a configuration described above, as shown in FIG. 6(*a*), a reading unit is provided with a pair of feed rollers 102 arranged upstream of the second platen 101, a pair of discharge rollers 103 arranged downstream of the second platen 101, and an curved reading path 106 including a guide 104 facing an upper surface of the second platen 101. After the feed rollers 102 feed the original from a sheet supply tray (not shown) disposed upstream of the feed rollers 102 to the second platen 101, a lifting member 105 disposed between the first platen 100 and the second platen 101 lifts and guides the original from the upper surface of the second platen 101 to the discharge rollers 103.

However, in the reading unit of such an original reading apparatus, when the lifting member 105 lifts a leading edge of the original from the second platen 101, the leading edge of the original strikes an oblique surface of the lifting member 105 to create a shock. As a result, the original tends to vibrate or be transported at a various speed at the reading position, thereby causing distortion of the read image. Further, when a trailing edge of the original passes through and exits a nipping point of the feed rollers 102, the trailing edge of the original drops downward to cause an unsteady transport of the original and a variation in the speed of the original, thereby causing distortion of the read image.

To solve these problems, another conventional apparatus is provided with a transparent film member 207 on the second platen 201, as shown in FIG. 6(*b*), so that the original is transported along the transparent film member 207.

The transparent film member 207 is arranged between a guide 204 and the second platen 201, and forms a curved reading path between the guide 204 and the film member 207. An end 207*a* of the transparent film member 207 is fastened to a backside of the guide 208 at an upstream side of the reading path 206, and the other end 207*b* is free and inserted into an inside of a downstream guide 209 of the reading path 206.

The transparent film member is made of a flexible material such as polyethylene terephthalate (Mylar), and is positioned to face substantially the entire length of the second platen 201 and touch the upper surface of the second platen 201. With this configuration, the feed rollers 202 feed the original supplied to the reading unit between the transparent film member 207 and the guide 204 to pass above the second platen 201. The reading means located stationary below the second platen 201 at the reading position reads the image on the original through the second platen 201 and the transparent film member 207. After reading the image, the original is guided to the discharge rollers 203 along the transparent film member 207 to discharge.

In the conventional automatic document feeder with the configuration described above, when the transparent film member 207 lifts the original, the leading edge of the original does not strike anything, thereby making it possible to obtain a good quality image. However, there is still a problem in which when the original passes through the nipping point of the feed rollers, the trailing edge of the original drops. Therefore, the original vibrates while transporting at various speeds at the reading position, thereby making it difficult to obtain a good quality image from the original.

In view of the problems describe above, an object of the present invention is to provide an automatic document feeder in which the original can be transported smoothly from the leading edge to the trailing edge at the reading position with a simple structure to obtain a good quality image.

Further objects and advantages of the invention will be apparent from the following description of the invention.

SUMMARY OF THE INVENTION

To attain the objects described above, according to the present invention, an automatic document feeder is provided with a reading unit disposed above a platen for reading a transported original. The reading unit includes a platen roller for transporting the original to the reading unit; guide means arranged between the platen and the platen roller and formed in a curved original reading path at a side of the platen; pressing means for pressing the guide means against the platen roller; and regulating means for creating a space between a surface of the platen roller and an upper surface of the platen. When the original is transported between the platen roller and guide means, the original moves the guide means toward the platen.

A transparent film member formed in the curved path is pressed against the fixed platen roller. The transparent film member deforms to pass the original when the original advances into a nip between the platen roller and the transparent film member.

With the configuration, it is possible to apply an appropriate pressing force and transport force to the original to prevent unsteady transportation without a complicated configuration. It is also possible to obtain stable reading of the image without scratching the film member. The platen roller is supported at a predetermined position above the platen.

According to the invention, the platen roller is arranged at a position away from the reading position of the reading unit. Specifically, in a direction that the platen roller transports the original, the platen roller is disposed at a position upstream of the reading position of the reading unit for pressing the original upstream of the reading position. Accordingly, when a trailing edge of the original exits from the transport means that transports the original toward the platen roller, the original is transported in a steady manner at the reading position. Further, even if the guide is scratched due to friction between the platen roller and guide means, the scratches occur at a position away from the reading position, thereby eliminating effect of the scratches on the reading of the original.

According to the present invention, the apparatus may be provided with the first transport means for transporting the original to the reading position of the reading unit and the second transport means for discharging the original from the reading position. The platen roller is arranged between the first transport means and the reading position. With this configuration, the platen roller is arranged to press the original at an upstream side of the reading position. Therefore, it is possible to prevent the original from vibrating at the reading position when the trailing edge of the original exits from a pair of transport rollers.

According to the invention, the guide means is formed in a flexible transparent film member, and has a guide member swinging freely and pressing the original between the guide means and the guide member at the reading position. The guide member presses the original at the reading position to eliminate small vibrations at the reading position when the original is lifted at downstream of the reading position. The flexible film member supports the original, thereby making it easy to adjust a pressure of the guide member applied to the original.

Further, according to the invention, the pressing means includes a fastening member for fastening one end of the transparent film member and supporting means for bending and supporting the transparent film member. The transparent film member is pressed against the platen roller with its elasticity. The film member is also pressed against the platen roller with its elasticity, thereby making the structure simple and low cost.

According to the invention, the pressing means may include the fastening member for fastening one end of the transparent film member and tension application means for applying tension and pressing the transparent film member against the platen roller. With this configuration, the tension is applied to the film member with a constant pressure regardless of an ambient temperature, humidity or aging of the parts.

DETAILED DESCRIPTION OF PREFERRED EMBODIMENTS

Figure 1:
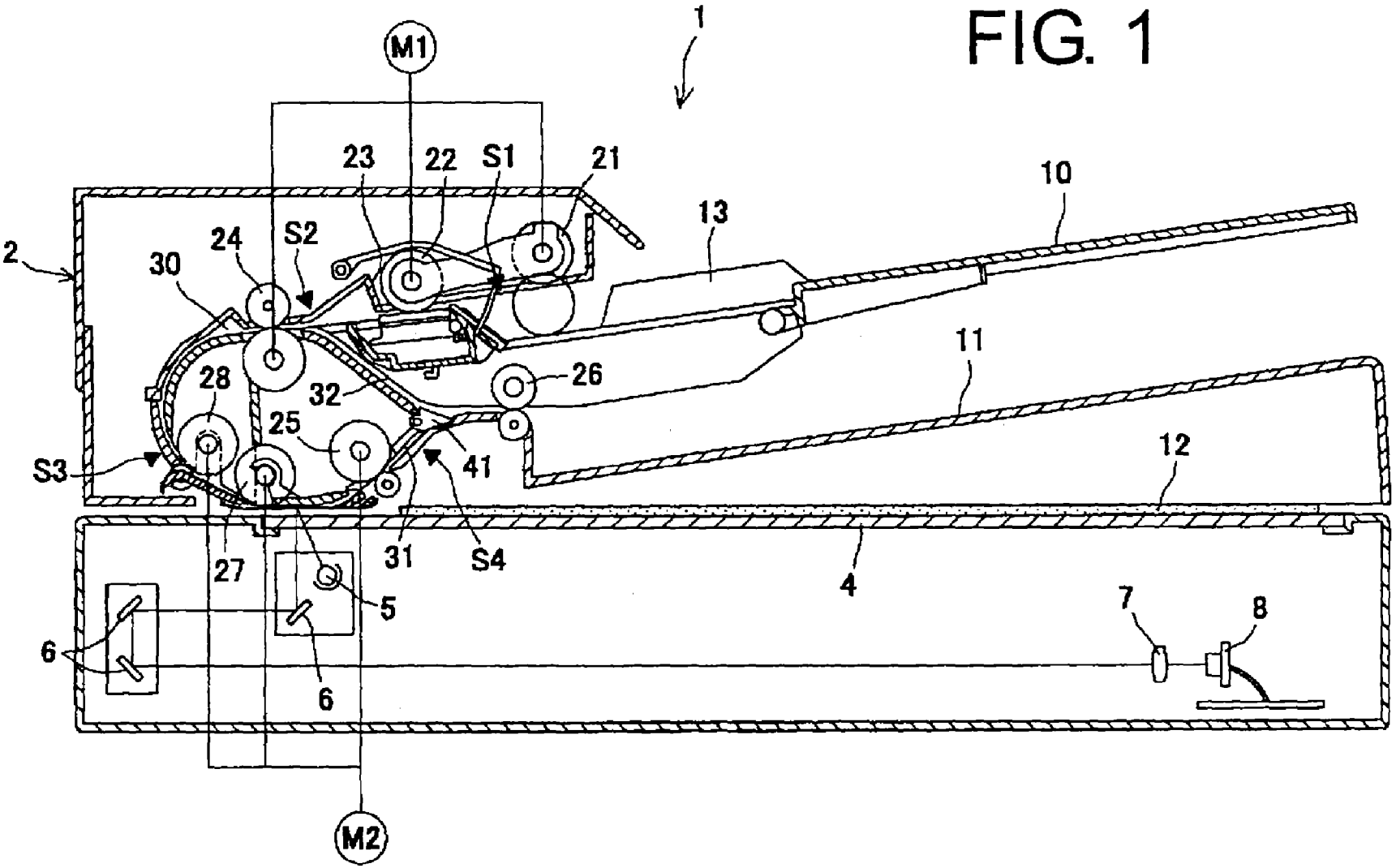
FIG. 1 is a view showing an overall structure of an automatic document feeder according to the present invention.
Figure 2:
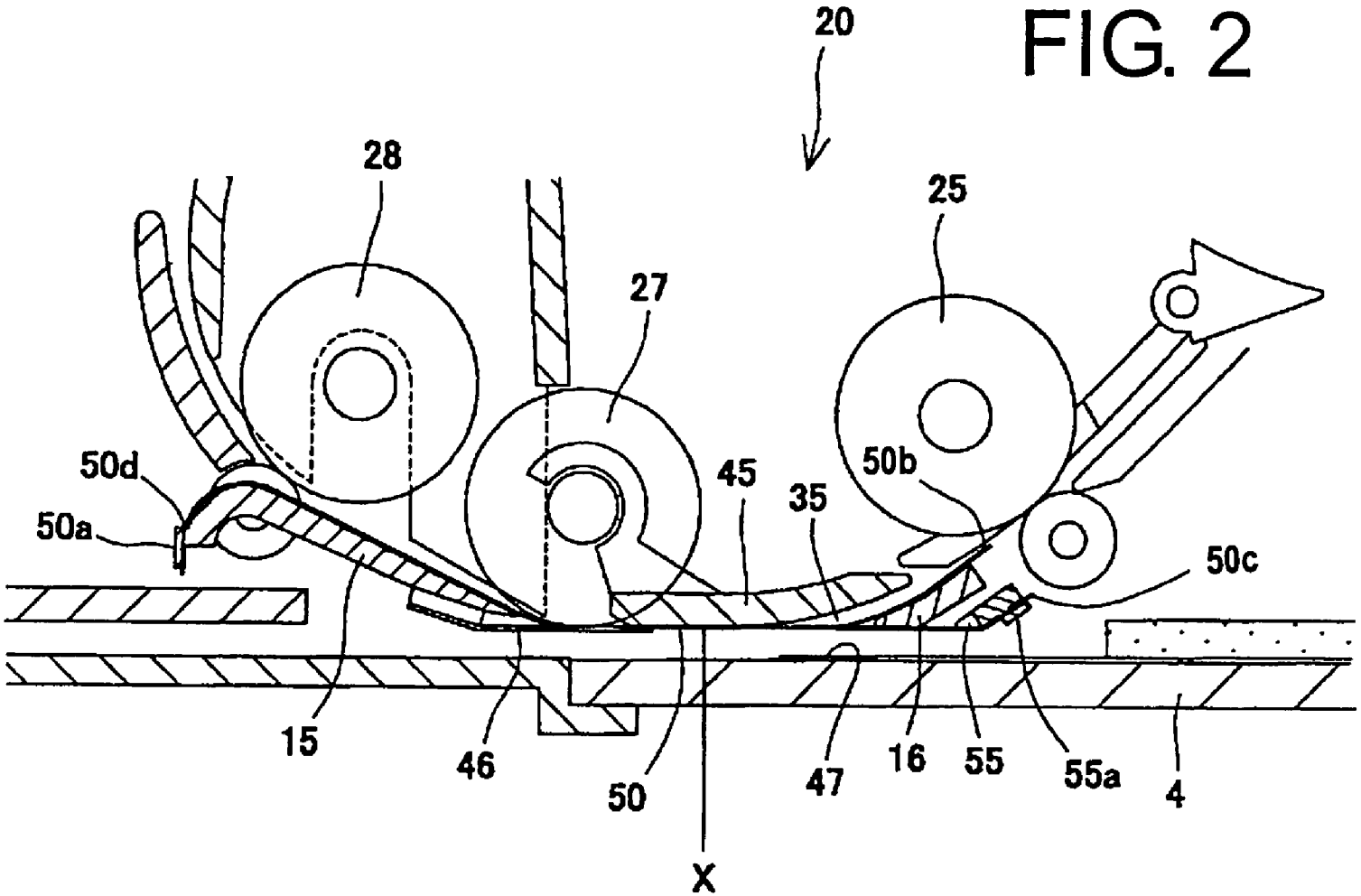
FIG. 2 is a view showing an essential portion of the automatic document feeder.

Hereunder, embodiments of the invention will be described with reference to the accompanying drawings. FIG. 1 is a view showing an automatic document feeder 2 mounted on an original reading apparatus 1 according to the present invention. FIG. 2 is a view showing a main portion of the automatic document feeder 2.

In a main unit of the original reading apparatus 1, a light source 5 such as a lamp radiates light onto a transported original through a platen 4. A plurality of mirrors 6 reflects the light from the original into a reading element 8 such as a CCD via a lens 7 to read an image on the original and convert photo-electrically. The original reading apparatus 1 has a mode in which an optical unit having the light source 5 and mirrors 6 moves in a sub-scanning direction to read an image on a thick original placed on a platen 4 through the platen 4, and a mode in which a stationary optical unit reads an original transported over the platen 4 by the automatic document feeder at a predetermined reading position.

In an embodiment of the apparatus shown in FIG. 1, the image reading apparatus is configured to have a two-carriage system. The present invention is also applicable to an image reading apparatus of a one-carriage system in which an optical reading device with one carriage, which has the light source 5, the mirrors 6, the lens 7 and the reading elements 8, moves below the platen 4 from the right side to the left side in the drawing to read an image on an original.

The automatic document feeder is provided with a sheet supply tray 10 for placing a plurality of the originals; a discharge tray 11 for storing the originals after reading, and a pressing cover 12 formed of a porous member such as a sponge and a film member such as a white Mylar film for pressing the platen 4.

A sheet supply portion is formed of a feed roller 21 movable vertically for touching and feeding the uppermost original stacked on the sheet supply tray 10; separating means having a sheet supply roller 22 for feeding the original fed by the feed roller 21 and a separating member 23 for allowing only the uppermost original to pass and blocking the subsequent sheets from being fed; and a pair of register rollers 24 for touching a leading edge of the original separated by the separation means to feed the original downstream.

The feed roller 21, the sheet supply roller 22 and the pair of the register rollers 24 guide the original on the sheet supply tray 10 along a sheet supply path 30. A sheet supply motor M1 is connected to drive the feed roller 21 and sheet supply roller 22 via a one-way clutch OW1 (not shown). The sheet supply motor M1 is also connected to drive the pair of the register rollers 24 via a one-way clutch OW2 (not shown). The sheet supply motor M1 rotates forward to drive the feed roller 21 and sheet supply roller 22, and rotates in reverse to drive the pair of the register rollers 24.

A pair of discharge rollers 26 is arranged in a discharge portion for discharging the original from a pair of discharge rollers 25 to the discharge tray 11 along the discharge path 31. A transport/discharge motor M2 capable of both forward and reverse rotations is connected to the pair of the discharge rollers 26. In a duplex mode, it is controlled to rotate the discharge rollers 26 in reverse while nipping the trailing edge of the original to return the original to the sheet transfer path 35 via a circulation path 32 to switchback the original.

A free-falling flapper 41 is disposed in the discharge path 31. When the leading edge of the original passes through, the flapper raises to pass the original, and after the trailing edge of the original passes through, the flapper falls downward. The free-falling flapper 41 guides the original into the circulation path 32 without any hindrance when the discharge rollers 26 rotate in reverse to switch back the original. The flapper 41 is constantly urged downward by an urging spring. When the original is fed to the pair of the discharge rollers 26 along the discharge path 31, the leading edge of the original raises the flapper 41 upward to allow the original to pass. When the pair of the discharge rollers 26 switch-backs the original, the flapper falls downward and covers the discharge path 31 to guide the original into the circulation path 32.

An empty sensor S1 is disposed at downstream of the sheet supply tray 10 in the original feeding direction for detecting the original stacked on the sheet supply tray 10. A register sensor S2 is disposed in the sheet supply path 30 for detecting the trailing edge of the original. A read sensor S3 is disposed in front of the reading portion and a discharge sensor S4 is disposed in front of the pair of the discharge rollers 26 for detecting the trailing edge of the original.

The sensors S1 to S4 are connected to control means having a CPU for controlling the transport of the original. Based on the detection signals from each of the sensors, the motors M1 and M2, mentioned above, and each solenoid SOL1 (not shown) are controlled to transport the originals.

A plurality of sensors is disposed on the sheet supply tray 10 in the original feeding direction for detecting a length of the original placed on the sheet supply tray 10 using signals output from the sensors. A side guide 13 is disposed on the sheet supply tray 10 for regulating the original in the width direction. A width of the original is determined by a volume (not shown) variably output according to an amount of movement of the side guide 13. Accordingly, it is possible to determine a size of the original based on the detection of the length and width of the original.

A structure of the reading portion 20 of the embodiment around the original reading position will be described next with reference to FIG. 2.

As shown in FIG. 2, the reading portion 20 is composed of a pair of transfer rollers 28 (the first transport means) for feeding the original to a reading position X; a transfer guide 15 for feeding the original from the transfer rollers 28 toward the reading position X; a discharge roller 25 for discharging the original read at the reading position X (the second transport means); a discharge guide 16 for guiding the original from the reading position X to the discharge roller 25; a transparent film member 50 (guide means) formed in a curved original reading path at the platen side extending between the transfer guide 15 and the discharge guide 16; a platen roller 27 disposed between the reading position X and the pair of the transfer rollers 28 at an upstream side away from the reading position in the original feeding direction for touching the transparent film member 50; and a white back-up guide 45 (guide member) facing the platen.

White film members 46 and 47 are disposed between the transparent film member 50 and the platen 4. The white film members 46 and 47 are disposed in front of and behind the reading position in the original feeding direction. The white film members 46 and 47 allow the light from the light source 5 to pass therethrough to attain a good quality image of a thin original manually placed on the platen 4.

Figure 3:
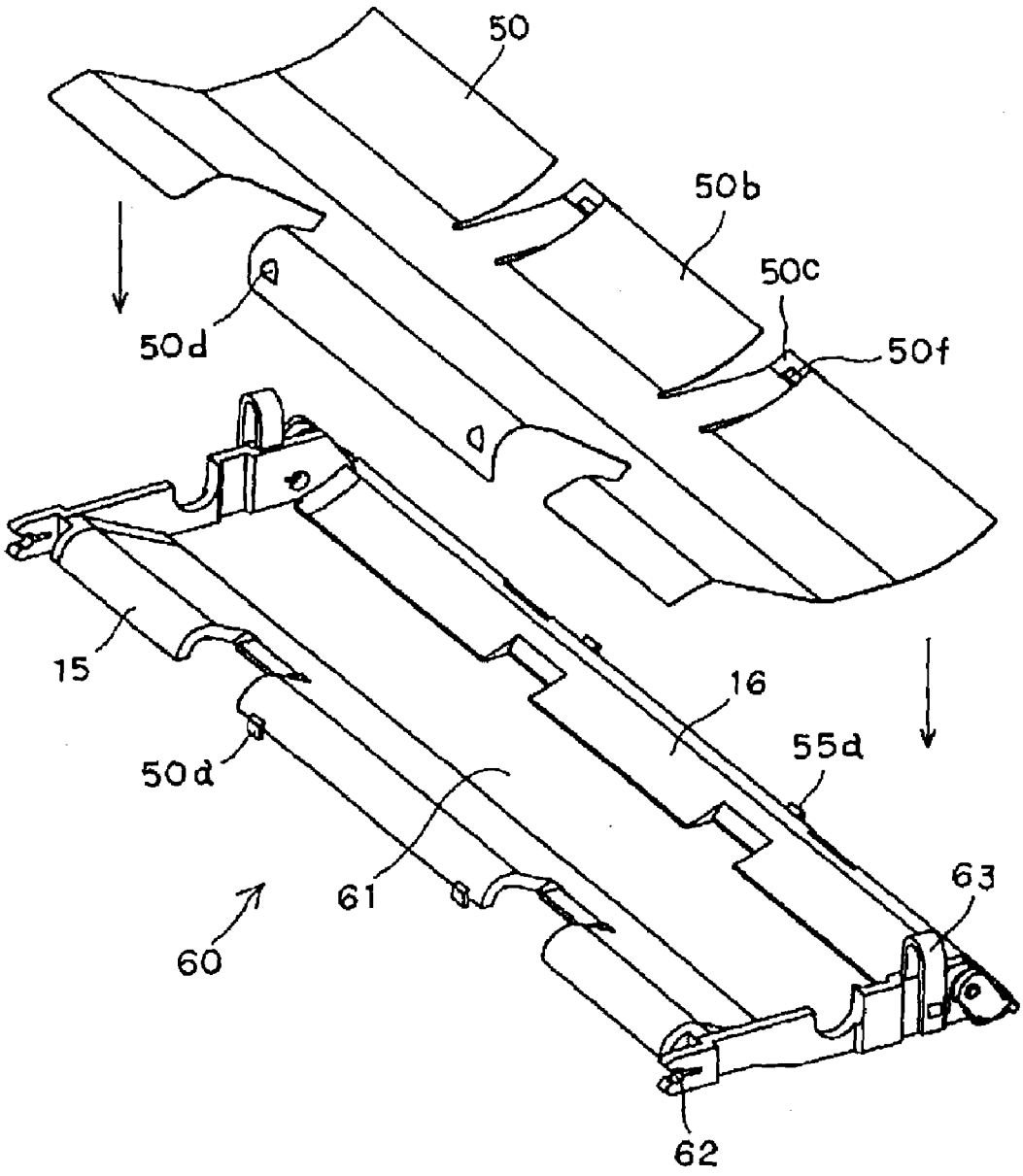
FIG. 3 is a perspective view of a configuration of a reading guide unit.

FIG. 3 is a perspective view showing a configuration of the transparent film member 50, the transfer guide 15 and the discharge guide 16.

A plurality of mounting holes 50*d* is formed at an edge of the transparent film member 50 at an upstream side in the original feeding direction. Protrusions 50*a* are formed on the transfer guide 15 as fasteners for engaging the mounting holes 50*d* so that the transparent film member 50 is supportably mounted. Tongue portions 50*b* and 50*c* separated into adjacent strips are formed at the other edge of the transparent film member 50 at a downstream side in the original feeding direction. The tongue portions 50*b* separated into the strips extend freely toward an original guiding surface of the discharge guide 16. The tongue portions 50*c* extend at a backside of the discharge guide 16. The mounting holes 50*f* formed in the leading edges of the tongue portions 50*c* engage the protrusions 55*a* formed on the tension application member 55 as the fasteners.

As described above, the transparent film member 50 is formed in a curved transfer path 35 from the original guiding surface of the transfer guide 15 along the original guiding surface of the discharge guide 16. The transparent film member 50 elastically presses an outer surface of the platen roller 27 at an upstream side away from the reading position X in the original feeding direction. Accordingly, when the transparent film member 50 is scratched due to friction with the platen roller 27, the scratch is away from the reading position and a position of the transparent film member 50 corresponding to the reading position X is not scratched, therefore eliminating an adverse effect on the reading of the original.

Figure 4:
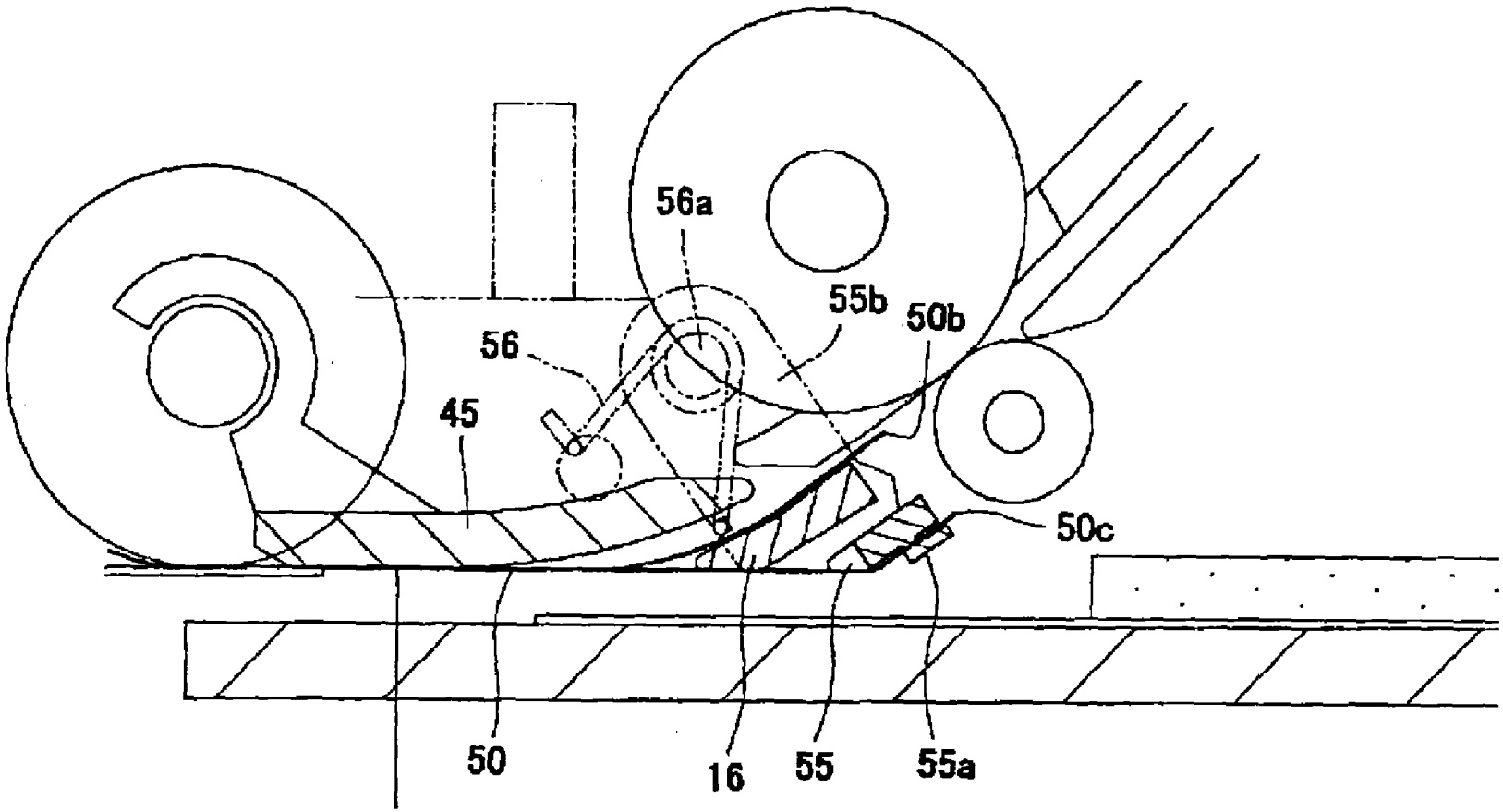
FIG. 4 is a sectional view of an essential portion of tension application means according to the present invention.

Predetermined spaces (0.5 mm to 1.0 mm) are formed between the platen 4 and the platen roller, between the platen 4 and the backup guide 45, and between the platen and transparent film member 50, so that the transparent film member 50 can swing in a direction opposite to a surface of the platen roller 27 (opposite to the guide surface of the transparent film member 50), i.e. downward in FIG. 3 and FIG. 4.

Figure 5:
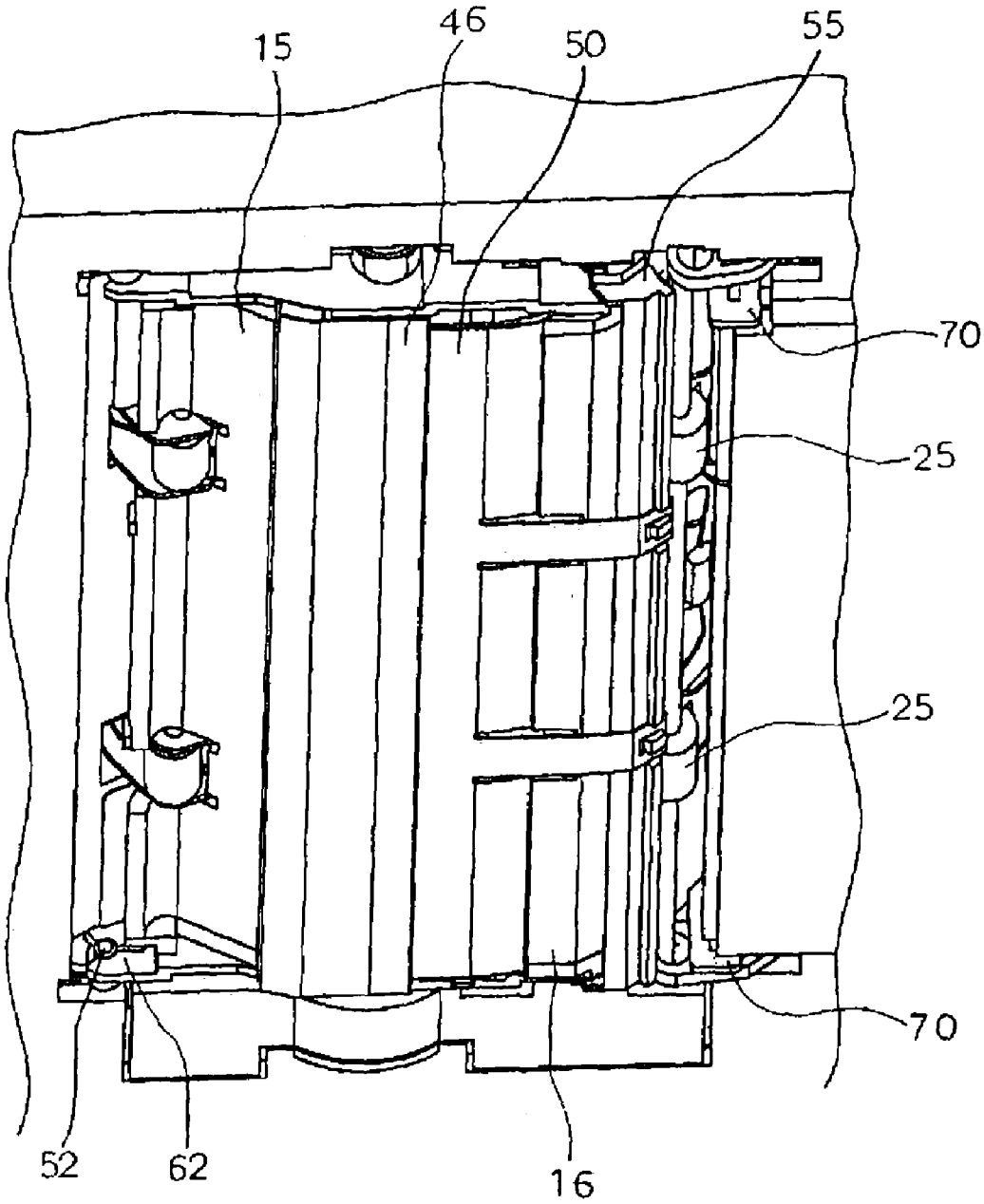
FIG. 5 is a backside view of the reading guide unit shown in FIG. 3.
Figure 6A:
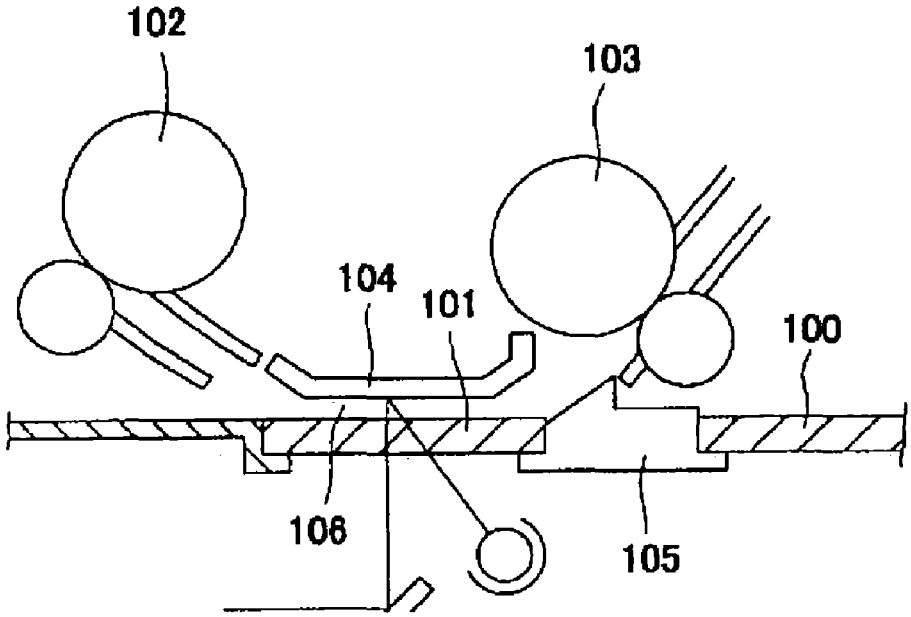
FIG. 6(a) Prior Art
FIGS. 6(*a*) and 6(*b*) are views showing a main portion of a conventional automatic document feeder.
Figure 6B:
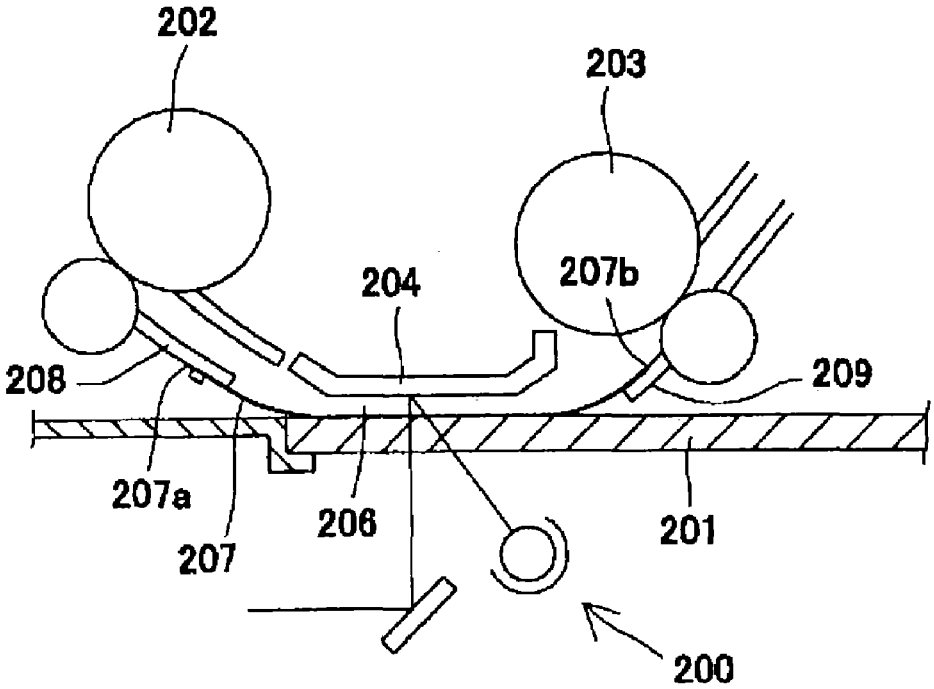
FIG. 6(b) Prior Art

As shown in FIG. 5, guide pieces 70 (regulating means) are formed on an apparatus frame, and protrude toward the platen 4 to abut against the upper surface of the platen 4. Along with the guide pieces 70, the platen roller 27 mounted on the apparatus frame regulates a position of the apparatus to form the spaces. The transparent film member 50 is displaced downward in FIG. 3 or FIG. 4 in the spaces by the original when the original enters between the platen roller 27 and the transparent film member 50 or between the backup guide 45 and the transparent film member 50. As a result, it is possible to smoothly transport the original through the original transport path.

A reading guide unit will be described next in detail with reference to FIG. 4 and FIG. 5. The transfer guide 15, discharge guide 16, transparent film member 50 and tension application member 55 form the reading guide unit 60. The reading guide unit 60 is detachably mounted to the apparatus frame.

As shown in FIG. 3, the transfer guide 15 and the discharge guide 16 are molded in integrated plastic parts, i.e. main components of the reading guide unit 60. An opening 61 is formed at the central location for reading the original. The transparent film member 50 is mounted at the opening 61. The tension application member 55 is also mounted at the opening 61 for supporting the transparent film member 50.

Notched portions 62 are formed on side portions of the reading guide unit 60 at an upstream side in the original feeding direction for inserting pins 52 formed on the apparatus frame shown in FIG. 5. Also, protruding portions 63 having a key-shape and convex portions are formed on the side portions of the reading guide unit 60 for engaging concave portions formed on the apparatus frame to support the reading guide unit at a predetermined position.

When the reading guide unit 60 is removed from the apparatus frame, first the protruding portions 63 are pressed to bend, so that the convex portions on the protruding portions 63 are pulled and released from the concave portions on the apparatus frame. Then, the reading guide unit 60 is rotated by a predetermined angle (for example, 90 degrees with regard to the apparatus frame) around the apparatus frame pins 52. The protruding portions 63 are made of a plastic and formed in a plate shape, thereby being easy to bend. Lastly, the reading guide unit 60 is pulled downward along the notched portions 62 on the reading guide unit 60 to be removed from the apparatus frame.

When the reading guide unit 60 is attached to the apparatus frame, in a reverse order of the process described above, the notched portions 62 on the reading guide unit 60 are pushed in to engage the pins on the apparatus frame. Then, the reading guide unit 60 is rotated, so that the concave portions on the apparatus frame engage the convex portions of the protruding portion 63 on the reading guide unit 60 to mount the reading guide unit 60 onto the apparatus frame.

Note that when it is necessary to remove just a small amount of dirt or dust on the transparent film member 50, the concave portions on the apparatus frame are released from the convex portions on the protruding portion 63, and the reading guide unit 60 is rotated by a certain angle around the apparatus frame pins to perform such simple maintenance as wiping away the dust.

FIG. 4 is an expanded view showing a tension application member 55 according to the embodiment of the invention. As shown in reference FIG. 3, the tension application member 55 is provided with protrusions 55*a* for fixing the transparent film member 50 when the protrusions 55*a* engage the mounting holes 50*f* on the tongue portion 50*c* of the transparent film member 50, and arm portions 55*b* having shaft holes for engaging pins formed on the reading guide unit frame.

A torsion coil spring 56 is disposed between the frame of the reading guide unit 60 and the arm portion 55*b* for rotatably urging the tension application member 55 in the original feeding direction around pivot shafts (rotating shaft) 56*a* formed on the side of the reading guide unit 60.

One end of the torsion coil spring is attached to the arm 55*b* of the tension application member 55, and the other end thereof is attached to the reading guide unit 60 for rotatably urging the tension application member 55 to apply tension to the transparent film member 50.

The tension is applied to the transparent film member 50. As a result, it is possible to eliminate a gap between the platen roller 27 contacting the transparent film member 50 and the upstream side of the discharge guide 16 contacting the tongue portions 50*c* of the transparent film member 50. Accordingly, the platen roller 27 is aligned substantially parallel to the discharge guide 16.

The transparent film member 50 is formed of an elastic material and the tension application member 55 can adjust the tension applied to the transparent film member 50. Therefore, the transparent film member 50 is displaced toward the platen 4 and pressed against an outer surface of the platen roller 27 even when the originals have various different thicknesses. As a result, it is possible to transport the originals in a stable manner without jamming at the reading position or varying the transport speed or direction.

As described above, according to the present invention, the apparatus includes the guide means formed in the curved original reading path at the platen 4 side; the pressing means for pressing the guide means against the platen roller 27; and the regulating means for forming the space having a predetermined distance between the roller surface of the platen roller 27 and the platen 4. The guide means is moved toward the platen 4 by the original transferred between the platen roller 27 and the guide means.

When the transparent film member 50 forming the curved path is pressed against the fixed platen roll 27, and the original enters the nip between the platen roller 27 and the transparent film member 50, the transparent film member 50 is displaced to allow the original to pass therethrough, so the structure is not complicated. It is possible to provide appropriate pushing and transport forces, so that the originals are transported without any variance in the transport speed or the direction of the original. Also, it is possible to prevent the film member from scratching, thereby attaining the stable and good quality images read from the originals.

In the apparatus of the present invention, the platen roller 27 is arranged upstream of the original reading position X and the original is pressed upstream of the reading position. Thus, it is possible to transport the original stably at the image reading position when the trailing edge of the original exits from the pair of the transfer rollers. Also, the guide member 45 presses the original at the reading position. Thus, it is possible to reduce the vibration of the original at the reading position when the original is lifted downstream of the reading position. The film member 50 formed of a flexible material supports the original, thereby making it easy to adjust the pressure of the guide member 45 applied to the original.

The platen roller 27 is arranged at a position away from the reading position. More specifically, the platen roller 27 is disposed at further upstream side of the reading position of the reading unit in the direction that the platen roller 27 feeds the original. Thus, even if the transparent film member 50 is scratched due to the friction between the platen roller 27 and the transparent film member 50, as the scratch occurs at a position away from the reading position, it is possible to prevent the adverse effect of the scratch.

While the invention has been explained with reference to the specific embodiments of the invention, the explanation is illustrative and the invention is limited only by the appended claims.

What is claimed is:

1. An automatic document feeder for feeding an original, comprising:

a reading portion having a reading position for reading the original;

a transparent film member as guide means disposed above the reading portion to form a curved original reading path;

a platen roller for transporting the original at the reading portion, said platen roller being arranged to press the guide means to transport the original between the guide means and the platen roller and positioned upstream relative to the reading position to thereby prevent scratching of the guide means at the reading position when the platen roller directly contacts the guide means;

regulating means projecting from a frame on the automatic document feeder by a predetermined distance; and pressing means for pressing the guide means to the platen roller so that the original moves the guide means toward a side opposite to the platen roller when the original enters between the platen roller and the guide means.

2. An automatic document feeder according to claim 1, further comprising a platen at which the reading portion is disposed, said guide means being located between the platen and the platen roller, and said regulating means contacting the platen to form a space between the platen roller and the platen.

3. An automatic document feeder according to claim 1, wherein said platen roller is disposed at a position away from the reading position in the original reading path.

4. An automatic document feeder according to claim 1, further comprising first transport means disposed upstream relative to the platen roller for transferring the original to the reading position, said platen roller being disposed between the first transport means and the reading position.

5. An automatic document feeder according to claim 4, further comprising second transport means for transferring the original transported by the platen roller from the reading position.

6. An automatic document feeder according to claim 1, wherein said transparent film member is flexible.

7. An automatic document feeder according to claim 1, further comprising a guide member disposed adjacent to the platen roller for pressing the original against the guide means at the reading position.

8. An automatic document feeder according to claim 6, wherein said pressing means comprises a fastening member for fastening one end of the transparent film member, and supporting means for bending and supporting the transparent film member so that the transparent film member is elastically pressed against the platen roller.

9. An automatic document feeder according to claim 6, wherein said pressing means comprises a fastening member for fastening one end of the transparent film member, and tension application means for applying tension to the transparent film member to press against the platen roller.

10. An automatic document feeder according to claim 2, wherein said platen roller is supported at a predetermined position above the platen.

11. An automatic document feeder for feeding an original, comprising:

a reading portion having a reading position for reading the original;

a flexible transparent film member as guide means disposed above the reading portion to form a curved original reading path;

a platen roller disposed at a position away from the reading position relative to a predetermined direction and transporting the original at the reading position in the predetermined direction, said platen roller being arranged to press the guide means to transport the original between the guide means and the platen roller and positioned upstream relative to the reading position to thereby prevent scratching of the guide means at the reading position when the platen roller directly contact the guide means; and pressing means for pressing the transparent flexible guide means against the platen roller.

12. An automatic document feeder for feeding an original, comprising:

a reading portion having a reading position for reading the original;

a platen at which the reading portion is disposed;

transport means for transferring the original to the reading position of the reading portion;

backup guide means arranged along a direction that the transport means transports the original to face the platen;

guide means arranged between the platen and the backup guide means and situated adjacent to the backup guide means to form an original reading path together with the backup guide means;

regulating means projecting from a frame for forming a space having a predetermined distance between the backup guide means and the platen; and pressing means for pressing the guide means against the backup guide means so that the original moves the guide means toward a side opposite to a guide surface of the guide means when the original enters between the backup guide means and the guide means.

13. An automatic document feeder according to claim 8, wherein said supporting means includes a transfer guide and a discharge guide integrally connected together to form a space therebetween, said transparent film member being arranged between the transfer guide and the discharge guide.

14. An automatic document feeder according to claim 13, wherein said platen roller is located adjacent to the transfer guide in the space between the transfer guide and the discharge guide.

15. An automatic document feeder according to claim 1, wherein said frame supports the platen roller and the guide means.

16. An automatic document feeder according to claim 12, wherein said frame supports the transport means, backup guide means, and the guide means.

* * * * *